United States Patent [19]

Wilson, Jr. et al.

[11] 4,210,518

[45] Jul. 1, 1980

[54] HYDROGEN-DONOR COAL LIQUEFACTION PROCESS

[75] Inventors: Edward L. Wilson, Jr.; Willard N. Mitchell, both of Baytown, Tex.

[73] Assignee: Exxon Research & Engineering Co., Florham Park, N.J.

[21] Appl. No.: 950,925

[22] Filed: Oct. 12, 1978

Related U.S. Application Data

[63] Continuation-in-part of Ser. No. 744,845, Jan. 24, 1977, abandoned.

[51] Int. Cl.[2] ..... C10G 1/06
[52] U.S. Cl. ..... 208/10
[58] Field of Search ..... 208/10

[56] References Cited

U.S. PATENT DOCUMENTS

| | | | |
|---|---|---|---|
| 3,645,885 | 2/1972 | Harris et al. | 208/8 LE |
| 3,671,418 | 6/1972 | Gatsis | 208/10 |
| 3,679,573 | 7/1972 | Johnson | 208/10 |
| 3,840,456 | 10/1974 | Yavorsky et al. | 208/10 |
| 3,884,794 | 5/1975 | Bull et al. | 208/10 X |
| 3,884,796 | 5/1975 | Hinderliter et al. | 208/10 X |
| 3,923,634 | 12/1975 | Silvestri et al. | 208/10 |
| 4,018,663 | 4/1977 | Karr, Jr. | 208/10 |

*Primary Examiner*—Delbert E. Gantz
*Assistant Examiner*—William G. Wright
*Attorney, Agent, or Firm*—Yale S. Finkle

[57] ABSTRACT

Improved liquid yields are obtained during the hydrogen-donor solvent liquefaction of coal and similar carbonaceous solids by maintaining a higher concentration of material having hydrogenation catalytic activity in the downstream section of the liquefaction reactor system than in the upstream section of the system.

17 Claims, 1 Drawing Figure

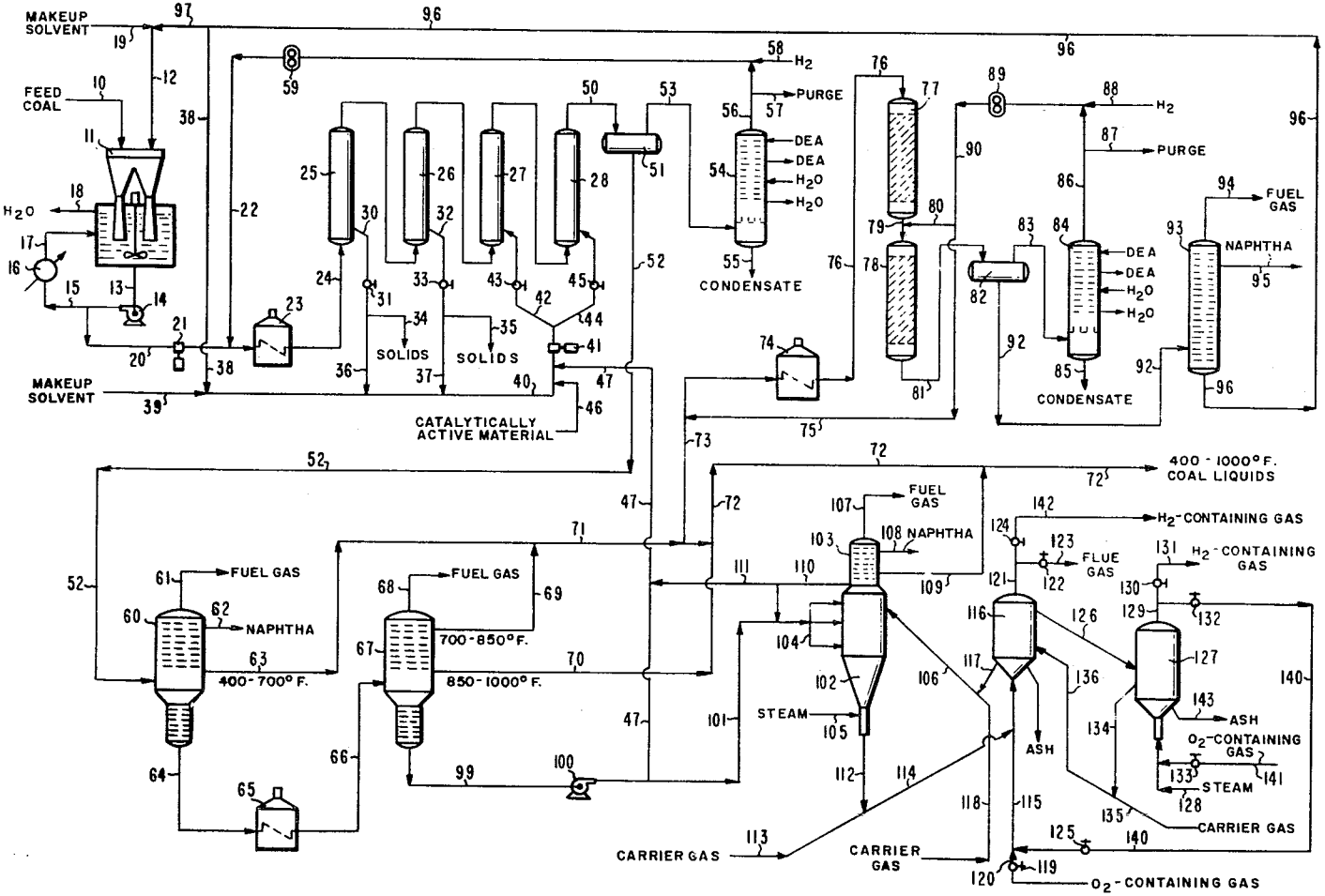
MAKEUP SOLVENT
FEED COAL
$H_2O$
MAKEUP SOLVENT
CATALYTICALLY ACTIVE MATERIAL
SOLIDS
SOLIDS
CONDENSATE
PURGE
$H_2$
DEA
DEA
$H_2O$
$H_2O$
CONDENSATE
PURGE
$H_2$
FUEL GAS
NAPHTHA
400 - 1000° F. COAL LIQUIDS
$H_2$-CONTAINING GAS
$H_2$-CONTAINING GAS
FLUE GAS
ASH
ASH
$O_2$-CONTAINING GAS
STEAM
CARRIER GAS
$O_2$-CONTAINING GAS
CARRIER GAS
CARRIER GAS
STEAM
FUEL GAS
NAPHTHA
FUEL GAS
700-850° F.
850-1000° F.
FUEL GAS
NAPHTHA
400-700° F.

HYDROGEN-DONOR COAL LIQUEFACTION PROCESS

CROSS REFERENCE TO RELATED APPLICATIONS

This application is a continuation-in-part of Ser. No. 744,845, filed in the U.S. Patent and Trademark Office on Jan. 24, 1977 now abandoned.

The Government of the United States of America has rights in this invention pursuant to Contract No. E(49-18)-2353 awarded by the U.S. Energy Research and Development Administration.

BACKGROUND OF THE INVENTION

1. Field of the Invention

This invention relates to the liquefaction of coal and similar carbonaceous solids and is particularly concerned with hydrogen-donor solvent liquefaction operations.

2. Description of the Prior Art

Hydrogen-donor solvent processes are among the most promising methods for the production of liquid hydrocarbons from coal and similar carbonaceous solids. In processes of this type, the coal or other feed material is contacted with molecular hydrogen and a hydrogen-donor solvent at elevated temperature and pressure in a liquefaction zone. High molecular weight constituents of the coal are broken down or cracked and hydrogenated to form lower molecular weight gaseous, vaporous and liquid products. The hydrogen-donor solvent and molecular hydrogen contributes hydrogen atoms which react with free radicals liberated from the coal and prevent their recombination. The molecular hydrogen also serves as replacement hydrogen for depleted hydrogen-donor molecules in the solvent and results in the formation of additional hydrogen-donor molecules by in situ hydrogenation. The effluent from the liquefaction zone is processed for the recovery of gases and vapors, liquid hydrocarbon in the solvent boiling range, and heavier constituents including a bottoms fraction containing suspended particles of unreacted coal, mineral matter and other solid residues. The solvent boiling range materials are further treated in a catalytic solvent hydrogenation zone to generate hydrogen-donor solvent for recycle to the liquefaction zone and produce additional liquid products.

The solvent boiling range material sent to the solvent hydrogenation unit in processes of the type described above are highly aromatic. The partial hydrogenation of these materials over a catalyst such as cobalt molybdate produces hydrogenated aromatics such as indane, $C_{10}$–$C_{12}$ tetrahydronaphthalenes, $C_{12}$ and $C_{13}$ acenaphthenes, di-, tetra- and octahydroanthracenes, tetrahydroacenaphthenes, crysenes, phenanthrenes, pyrenes and the like. These hydrogenated aromatics contain donatable hydrogen which reacts with the free radicals as described above. Laboratory work and pilot plant studies have shown that the concentration of donatable hydrogen in the solvent must be maintained at a high level if high liquefaction liquid yields are to be obtained. If this concentration falls below about 2 weight percent, based on the feed coal to the liquefaction reactor, the liquefaction yields tend to be adversely affected.

It has been proposed that coal liquefaction operations be improved through the use of a hydrogenation catalyst in the liquefaction zone. The catalysts typically mentioned have been compounds of cobalt, molybdenum, nickel, tin, iron and similar metals deposited on carries such as alumina, magnesia, silica and the like. It has also been suggested that coal ash and similar materials which appear to have catalytic activity be used for this purpose. Various means for carrying out the liquefaction reaction in the presence of solid catalysts particles have been devised. It has also been suggested that the coal be impregnated with solutions of catalytically active material prior to the liquefaction step. In general, however, it has been found that catalysts are of only limited value in processes using hydrogen-donor solvents and that the added costs associated with the use of a catalyst may be difficult to justify.

SUMMARY OF THE INVENTION

The present invention provides an improved hydrogen-donor solvent process for converting coal and similar carbonaceous solids into liquid hydrocarbons which makes possible higher yields of lower molecular weight liquid hydrocarbons than have generally been obtained in the past. This improved process is based in part upon the fact that materials which catalyze the hydrogenation of aromatic compounds to form hydroaromatics at the temperatures normally employed in the solvent hydrogenation step of hydrogen-donor solvent coal liquefaction processes tend to behave as dehydrogenation catalysts at the higher temperatures normally employed in the liquefaction or coal conversion step of such processes. This dehydrogenation activity during liquefaction limits the extent to which in situ hydrogenation of the solvent by molecular hydrogen takes place within the liquefaction reactor and results in lower donatable hydrogen concentrations than might otherwise be achieved. This in turn limits the coal conversion level during the liquefaction step and results in relatively lower yields of liquid products.

In accordance with the invention, it has now been found that the difficulty outlined above can be alleviated during the hydrogen-donor solvent liquefaction of coal and other carbonaceous solids by employing a catalytically active hydrogenation-promoting material in the liquefaction zone and maintaining the concentration of this material at a higher level in the downstream section of the liquefaction zone than in the upstream section of the zone. The hydrogen-donor solvent recycled to the liquefaction zone from the solvent hydrogenation zone will normally have a relatively high hydroaromatics content and hence the thermodynamic equilibrium in the upstream section of the liquefaction zone will favor the dehydrogenation of hydroaromatics to form aromatic compounds. As the solvent proceeds through the liquefaction zone, it gives up donatable hydrogen and hydroaromatic compounds which were present in the entering solvent are converted to aromatics. In the downstream section of the zone, the concentration of hydroaromatics is normally relatively low and hence the thermodynamic equilibrium will normally favor the hydrogenation of aromatics to produce hydroaromatics. By introducing the catalytic material into the downstream section of the liquefaction zone at a point where the thermodynamic equilibrium favors the hydrogenation of aromatics and thus maintaining a catalyst concentration gradient across the zone, the hydrogenation-promoting activity of the catalytic material can be utilized to maintain a relatively high concentration of donatable hydrogen in the solvent in the downstream section of the liquefaction zone. This higher donatable hydrogen concentration results in greater conversion of the coal or other feed material into lower molecular weight liquids in this section of the zone and makes possible higher overall yields of liquid products than might otherwise be obtained. Normally, at least 10 weight percent of the unconverted coal passing from the upstream section of the liquefaction zone into the downstream section, where the thermodynamic equilibrium favors hydrogenation of aromatics, undergoes chemical conversion into lower molecular weight materials in the downstream section. Between about 20 and about 40 weight percent of the unconverted coal entering the downstream section is further converted into low molecular weight gases and liquids when the residence time in the downstream section is between about 20 and about 40 minutes.

The process of the invention can be carried out with any of a variety of hydrogen-donor solvents. It is normally preferred, however, to employ a coal-derived solvent containing at least 30 weight percent of compounds which are recognized as hydrogen donors at temperatures in the range of from about 700° to about 900° F. Solvents containing at least 50 weight percent of such compounds are particularly effective. Similarly, any of a variety of catalytically active materials which promote the hydrogenation of aromatics to form hydroaromatics under liquefaction conditions may be employed. Suitable materials include minerals containing iron, nickel, cobalt, copper, zinc, tungsten, chromium, and the like. Minerals of this type include pyrite, copperas, bornite, chalcocite, pyrrhotite, smithsonite, sphalerite and so forth. It will be recognized that the composition of such minerals may differ from one location to another and that the catalytic activity may change considerably due to small differences in composition. Tests to determine the catalytic activity will therefore normally be conducted before selecting a mineral for use as a catalyst. Other materials which may be employed include catalytically active mineral matter recovered from the coal being liquefied or from other coals. As pointed out earlier, it is known that the ash-forming constituents of many coals and similar carbonaceous solids will promote the catalytic hydrogenation of aromatics to produce hydroaromatics. Also useful for purposes of the invention are manufactured hydrogenation catalysts such as those prepared from metals from Groups VI-B and VIII of the Periodic Table. Such catalysts typically comprise an alumina or silica-alumina support carrying one or more iron group metal oxides or sulfides in combination with one or more Group VI-B metal oxide or sulfide and are exemplified by cobalt molybdenum and nickel-molybdenum hydrotreating catalysts. Still other organic and inorganic compounds which have been recognized as having catalytic activity for the hydrogenation of aromatics to hydroaromatics under coal liquefaction conditions can also be used. Hydrogen-donor solvents and catalytic materials suitable for purposes of the invention have been described in the literature.

The liquefaction or coal conversion step in the process of the invention will normally be carried out in two or more upflow liquefaction reactors arranged in series but may be conducted in other multistage reactor systems. It will be understood that even if the liquefaction or reaction zone is comprised of more than one reactor, it is still considered to be a single liquefaction zone since each reactor is operated at substantially the same temperature and pressure and the high molecular weight constituents of the carbonaceous solids undergo chemical conversion into lower molecular weight constituents in each reactor. The only change in temperature and pressure from one reactor to another will normally be caused by small fluctuations in temperature and the pressure drop across the reactors.

The required concentration gradient of catalytically active material may be established and maintained by introducing catalytically active material into the downstream section of the liquefaction zone or by withdrawing catalytically active material from the upstream section of the zone and introducing this or a different catalytically active material into the downstream section of the zone. If the coal or other carbonaceous material to be chemically converted to low molecular weight liquids is one which contains mineral matter having little or no catalytic activity, a catalytically active material which will promote the hydrogenation of aromatics to form hydroaromatics will normally be added to the downstream section of the zone. If, on the other hand, the mineral matter present in the coal has significant catalytic hydrogenation activity, mineral constituents will normally be withdrawn from the upstream section of the liquefaction zone and this same material or another catalyst may be added to the downstream section of the zone. The method employed for the withdrawal of mineral matter and the addition of catalyst will depend to a large extent upon the particular type of reactor utilized and may be varied as necessary.

The process of the invention has pronounced advantages over earlier liquefaction processes in that it results in substantially higher yields of liquid products than are normally obtained in the other processes. This in turn results in greater process efficiency, better overall carbon utilization and lower product costs. As a result, the process has widespread application.

BRIEF DESCRIPTION OF THE DRAWING

The drawing is a schematic flow diagram of an integrated coal liquefaction process carried out in accordance with the invention.

DESCRIPTION OF THE PREFERRED EMBODIMENTS

The process illustrated in the drawing is a hydrogen-donor solvent liquefaction process in which bituminous coal, subbituminous coal, lignite or other liquefiable carbonaceous solids feed material is converted into low molecular weight liquids by contacting the material with molecular hydrogen and a hydrogen-donor solvent under liquefaction conditions. The liquefaction effluent is separated into an overhead stream containing vapors and gases which is recycled with makeup hydrogen following the removal of contaminants and condensable hydrocarbons and a liquids stream which is fractionated to produce hydrocarbons in the solvent boiling range and a heavy bottoms fraction containing constituents normally boiling in excess of about 1000° F. The solvent boiling range liquids are hydrogenated for the production of recycle solvent and the bottoms stream is fed to a pyrolysis unit for the production of additional liquid products and coke which is gasified to generate hydrogen useful in the process. It will be understood that the invention is not restricted to this particular hydrogen-donor solvent liquefaction process and instead may be carried out in any of a variety of other liquefaction operations which employ hydrogen-donor solvents.

In the process depicted in the drawing, feed coal is introduced into the system through line 10 from a coal storage or feed preparation zone not shown and discharged into a slurry drying unit 11 where a slurry of the feed solids in a hydrogen-donor solvent introduced through line 12 is prepared. The feed coal employed will normally consist of solid particles of bituminous coal, subbituminous coal, lignite or a mixture of two or more such materials having a particle size on the order of about ¼ inch or smaller along the major dimensions. It is generally preferred to employ coal which has been crushed and screened to a particle size of about 8 mesh or smaller on the U.S. Sieve Series scale. The slurry drying unit will normally comprise an agitated drum in which the coal is suspended in hot hydrogen-donor solvent in a ratio of from about 0.8 to about 2 pounds of solvent per pound of dry coal. The temperature in the unit is maintained between about 250° and about 350° F. by recycling a portion of the slurry withdrawn through line 13 by means of slurry pump 14. The recycle stream passes through line 15 and heat exchanger 16 and is reintroduced into the slurry dryer drum through line 17. Moisture present in the feed coal is vaporized at the drum temperature and withdrawn through line 18. This vapor stream will normally include some solvent vaporized with the water and hence it will generally be passed through heat transfer equipment not shown in the drawing to condense the solvent and permit its recovery. It is normally preferred to operate the slurry dryer so that the water content of the slurry is maintained at a level below about 2% by weight.

As pointed out earlier, the hydrogen-donor solvent used in preparing the slurry will normally be a coal-derived solvent, preferably a hydrogenated recycle solvent containing at least 30% by weight of compounds which are recognized as hydrogen donors at temperatures between about 700° and about 900° F. or higher. Solvents containing at least 50% by weight of compounds such as indane, $C_{10}$–$C_{12}$ tetrahydronaphthalenes, $C_{12}$ and $C_{13}$ acenaphthenes, di-, tetra- and octahydroanthracenes, tetrahydroacenaphthenes, crysenes, phenanthrenes, pyrenes and other derivatives of partially saturated aromatic hydrocarbons are preferred. The solvent composition resulting from the hydrogenation of recycle solvent fractions produced in the process will depend to some extent upon the particular coal used as the feedstock, the process steps and operating conditions employed, and the conditions used in hydrogenating the solvent selected for recycle following liquefaction. It is generally preferred that the solvent be mixed with the feed coal in a ratio of from about 1.0 to about 5.0 pounds of solvent per pound of dry coal. The solvent employed on initial startup of the process and any makeup solvent that may be needed can be added to the system through line 19. During normal operation, the process produces an excess of liquid hydrocarbons in the solvent boiling range and hence the addition of makeup solvent is not ordinarily required.

The coal-solvent slurry not recycled to the slurry preparation drum is passed through line 20 and slurry pump 21 where the pressure is raised to the liquefaction pressure of about 1000 to about 3000 psig, preferably to between about 1500 and about 2500 psig. High pressure treat gas composed primarily of hydrogen but also including lesser quantities of carbon monoxide is introduced into the slurry downstream of the pump through line 22 in an amount sufficient to supply from about 1 to about 8 weight percent, preferably from about 2 to about 7 weight percent, of molecular hydrogen on a moisture and ash-free coal basis. The resulting stream is then passed into mixed phase preheat furnace 23 where it is heated to a temperature within the range between about 775° F. and about 950° F. or higher. In lieu of this heating procedure, the treat gas can be separately preheated in a furnace not shown in the drawing and thereafter mixed with the hot slurry downstream of furnace 23.

The hot slurry containing suspended coal particles, hydrogen-donor solvent, and molecular hydrogen is passed through line 24 into the first of a series of upflow liquefaction reactors 25, 26, 27 and 28. Although four reactors are shown, a greater or lesser number may be employed. Reactors of other types can also be used in some cases. Within the liquefaction reactors, all of which are maintained at substantially the same temperature and pressure and therefore constitute a single liquefaction zone, temperatures between about 775° and about 950° F., preferably between about 800° and 900° F. and pressures between about 1000 psig and about 3000 psig, preferably between about 1500 and about 2500 psig, are maintained. The liquid residence time within the liquefaction zone will normally range between about 10 minutes and about 120 minutes, preferably between about 10 and about 80 minutes.

Within the liquefaction zone, high molecular weight constituents of the feed coal are cracked and hydrogenated to form lower molecular weight gases, vapor and liquid products. The temperature is normally not allowed to drop below about 775° F. since lower temperatures inhibit cracking and thereby substantially reduce the amount of coal chemically converted into low molecular weight liquids. The liquid products will include heavy constituents having boiling points at atmospheric pressure in excess of about 1000° F. Unconverted coal and solids containing ash-forming constituents remaining following the conversion will also be present. If the liquefaction zone is comprised of more than one liquefaction reactor, the liquids, unconverted coal and mineral constituents exiting each reactor, except the final one, will be passed into the next reactor in the series, preferably without removing any of the unconverted coal or mineral matter. The hydrogen-donor solvent contributes hydrogen atoms which react with organic radicals liberated from the coal and prevent their recombination. Hydrogen present in the treat gas injected into the slurry serves as replacement hydrogen for depleted hydrogen-donor molecules in the solvent and results in the formation of additional hydrogen-donor molecules by in situ hydrogenation. The hydrogen also serves to stabilize organic radicals generated by the cracking of coal molecules. The process conditions within the liquefaction zone are selected to insure the generation of sufficient hydrogen-donor precursors and at the same time provide sufficient liquid product for proper operation of the solvent hydrogenation zone to be described hereafter. These conditions may be varied as necessary.

The donatable hydrogen concentration of the solvent in the slurry fed to liquefaction reactor 25 will normally range from about 1½ weight percent to about 3 weight percent, based on the coal in the slurry. This represents an excess of hydroaramatics over the equilibrium value at the liquefaction temperature of about 775 to about 950° F. Any iron compounds or other catalytically active constituents in the mineral matter of the coal which tend to promote hydrogenation and dehydrogenation reactions will under these conditions promote dehydrogenation of the hydroaromatics to liberate molecular hydrogen and form the corresponding aromatic compounds, resulting in a decrease in the concentration of donatable hydrogen in the system. This dehydrogenation, conversion of hydroaromatics to aromatics, and liberation of molecular hydrogen due to catalytic action is accompanied by the dehydrogenation of hydroaromatics as a result of the reaction of donatable hydrogen from the hydroaromatic compounds with free radicals liberated from the coal due to thermal cracking and other reactions.

The catalytic dehydrogenation which takes place in reactor 25 reduces the amount of donatable hydrogen available for reaction with the free radicals and thus decreases the overall effectiveness of the process in this initial section of the liquefaction zone. Eventually a point will be reached, normally about midway through the liquefaction zone, at which dehydrogenation and the loss of donatable hydrogen has progressed sufficiently that thermodynamic equilibrium favors hydroaromatics rather than aromatic compounds. At this point, catalytic dehydrogenation due to the presence of catalytically active mineral matter in the coal and coal residues will cease and the reverse hydrogenation reaction will commence. The molecular hydrogen contained in the feed stream to the liquefaction zone reacts with aromatic compounds in the solvent to produce hydroaromatics, thus tending to increase the quantity of donatable hydrogen in the solvent. This generation of donatable hydrogen tends to offset the consumption of such hydrogen due to reactions with free radicals from the coal and maintain sufficient donor hydrogen for liquefaction to continue without the production of excessive quantities of coke and gases. Studies have shown that it is particularly important that there be an adequate supply of donatable hydrogen near the outlet of the liquefaction zone if satisfactory yields of coal liquids are to be obtained. The amount of donatable hydrogen present at any point in the liquefaction zone can be determined by withdrawing samples of the solvent at that point, analyzing the samples to determine the relative quantities of various aromatic and hydroaromatic compounds present, and then calculating the donatable hydrogen concentration.

In the process of this invention, a concentration gradient of catalytically active material which tends to promote hydrogenation and dehydrogenation reactions under liquefaction conditions is maintained across the liquefaction zone so that the concentration of such material is higher in the downstream section near the outlet of the liquefaction zone than in the upstream section near the inlet of the liquefaction zone. This may be done in several different ways, depending in part upon the composition of the mineral matter associated with the feed coal. The variations in mineral matter composition are illustrated by the analyses of two typical coals which may be employed for liquefaction purposes. One of these coals is an Eastern bituminous coal and the other is a Western subbituminous coal. The analyses are set forth in Table I below.

TABLE I

| | Coal Compositions | |
|---|---|---|
| | Illinois No. 6 Coal | Wyodak Coal |
| Ultimate Analysis Wt. % Dry Basis | | |

TABLE I-continued

| | Coal Compositions | |
|---|---|---|
| | Illinois No. 6 Coal | Wyodak Coal |
| Carbon | 70.1 | 68.5 |
| Hydrogen | 5.1 | 4.9 |
| Oxygen (by difference) | 10.6 | 17.2 |
| Nitrogen | 1.2 | 0.5 |
| Sulfur | 4.1 | 1.1 |
| Ash, (Ash, $SO_3$-free) | 8.9 (8.8) | 7.8 (6.6) |
| Total | 100.0 | 100.0 |
| Moisture Content, Wt. % (As received) | 14.0 | 29 |
| Higher Heating Value Btu/lb. (Dry) | 12,650 | 11,730 |
| Ash Analysis ($SO_3$-free), Wt. % Oxides, Dry Ash | | |
| $P_2O_5$ | 0.2 | 0.8 |
| $SiO_2$ | 53.2 | 35.2 |
| $Fe_2O_3$ | 19.5 | 5.3 |
| $Al_2O_3$ | 18.9 | 22.9 |
| $TiO_2$ | 1.0 | 1.5 |
| CaO | 3.2 | 25.3 |
| MgO | 1.2 | 7.0 |
| $Na_2O$ | 0.8 | 1.0 |
| $K_2O$ | 2.0 | 1.0 |
| Total | 100.0 | 100.0 |

It will be noted from the above table that the Illinois No. 6 coal contains substantially more iron than does the Wyodak coal. Other things being equal, it would therefore be anticipated that the mineral matter in the Illinois coal would be considerably more catalytically active than that of the Wyodak coal. As pointed out earlier, however, coal mineral matter normally contains many different metals, including a large number of trace metals which are not shown in the above analyses. Metals other than those set forth above which may be present include lithium, rubidium, strontium, barium, bismuth, berylium, cobalt, copper, chromium, manganese, molybdenum, lead, antimony, tungsten, zinc, zirconium, and others. The amounts in which these metals are present may vary considerably from one coal to another and hence one cannot readily predict the catalytic activity of the mineral matter in a particular coal. This catalytic activity can be readily determined, however, by heating samples of the coal in the presence of a donor solvent or a mixture of aromatics and hydroaromatics under controlled conditions and observing the effect on the composition of the solvent or mixture.

In the case of coals which contain mineral matter having relatively high catalytic activity, it is normally advantageous to withdraw solids of relatively high mineral matter content from the initial section upstream of the midpoint of the liquefaction zone. In the system shown in the drawing, this mineral matter is withdrawn from liquefaction reactor 25 through line 30 containing valve 31 and from liquefaction reactor 26 through line 32 containing valve 33. The solids may be withdrawn with any of a number of different ways. One system which may be used, for example, is to take off a stream of liquid and solids from a point near the lower end of the reactor, inject sufficient treat gas or solvent into the withdrawal line to effect a partial separation of relatively light solids of low mineral matter content from relatively heavy solids of high mineral matter content by elutriation, return the lighter materials to the reactor with the elutriating fluid, and recover the heavier materials for discharge from the system through line 34, 35, or both, or for recycle to the liquefaction zone through line 36 or 37 as described hereafter. In order to simplify the drawing, the lines through which the elutriating fluid is injected have not been shown. Elutriation systems are well known to those skilled in the art and hence the illustration of these lines is not necessary for an understanding of the process. Another system, not shown in the drawing, which may be used involves the passage of a stream of fluid and solids withdrawn from the reactor through a hydroclone or similar device operated so that most of the fluid and lighter solids will be taken overhead from the device and the heavier solids of relatively high mineral matter content will be discharged as an underflow stream that can be withdrawn from the system or recycled to the liquefaction zone. Still other systems that may be employed will suggest themselves to those skilled in this art.

The quantity of solids withdrawn from the liquefaction reactor will depend in part upon the composition of the mineral matter in the coal, the operating conditions in the reactor, and other factors but will normally range between about 1% and about 10%, based upon the weight of the solids fed to that reactor. It is not necessary that the same quantity of solids be withdrawn from each reactor in the upstream section of the liquefaction zone. The optimum withdrawal rate for a particular operation can be readily determined.

The withdrawal of solids from one or more liquefaction reactors as described above, in the case of coals containing catalytically active mineral matter, reduces the amount of such matter in the initial section of the system. The lower concentration in the initial section tends to reduce the extent to which catalytic dehydrogenation of hydroaromatics takes place and thus tends to increase the amount of donatable hydrogen present in the initial section of the liquefaction zone. Even in the case of coals containing little or no catalytically active mineral constituents, this withdrawal of solids may be advantageous in that it serves to eliminate ash from the system and improves downstream operations.

As pointed out earlier, the reactions which take place within the liquefaction zone normally cause a reduction in the donatable hydrogen content of the solvent as it moves through the zone. The extent to which this occurs depends on, among other things, the catalytic activity of the mineral matter in the coal, the amount of such mineral matter present, the temperature in the liquefaction zone, the amount of molecular hydrogen present and the like. The thermodynamic equilibrium between aromatics and hydroaromatics varies with temperature. This is illustrated by thermodynamic equilibrium data for pure compounds at different temperatures as shown in Table II below.

TABLE II

| Equilibrium Data for Pure Compounds | | |
|---|---|---|
| | Mol % First Ring Saturation | |
| Aromatic | 700° F. | 840° F. |
| Naphthalene | 95 | 70 |
| Phenanthrene | 100 | 65 |
| Pyrene | 65 | 10 |

It can be seen from the above table that the amount of first ring saturation for naphthalene, phenanthrene and pyrene decreases with increasing temperature. These compounds are normally present in coal-derived solvents employed in liquefaction operations and the temperatures shown are representative of those that may be employed in solvent hydrogenation and liquefaction operations. At the higher temperatures used in liquefaction operations, the compounds are less saturated and therefore have considerably less denotable hydrogen. A further illustration of the reduction in donatable hydrogen is shown by the following pilot plant data obtained with a liquefaction reactor temperature of 840° F. and a hydrogenation reactor temperature of 700° F. The data indicate the concentration of tetralin in the hydrogen-donor solvent at the entrance and exit of a coal liquefaction reactor. Data are shown for both Illinois No. 6 coal and Wyodak coal.

TABLE III

| Hydroaromatic/Aromatic Ratio in Donor Solvent | | |
|---|---|---|
| | Mol %, Tetralin/(Tetralin & Naphthalene) | |
| Donor Solvent | Illinois Coal | Wyodak Coal |
| Entering Reactor | 86 | 72 |
| Leaving Reactor | 56 | 21 |

It can be seen from the above data that the mole percent tetralin in the solvent, as a percentage of total tetralin and naphthalene, was substantially lower in the solvent leaving the reactor than in that entering the reactor with both the Illinois and the Wyodak coal. The concentration of the hydroaromatic tetralin in both cases was below the thermodynamic equilibrium concentration for the temperature at which the reactor was operated. This demonstrates that the solvent is dehydrogenated past the thermodynamic equilibrium point during liquefaction and that hydrogenation would therefore be favored in the downstream section of the liquefaction zone.

The catalytic hydrogenation of aromatics to form hydroaromatics is promoted in the process of the invention by the addition of catalytically active hydrogenation promoting materials to the liquefaction zone downstream of the midpoint of the zone. As indicated earlier, the catalytically active material employed may be mineral matter recovered from the coal being liquefied or from another coal, an inexpensive mineral such as pyrite ($FeS_2$) or copperas ($FeSO_4.7H_2O$) or the like which has catalytic hydrogenation activity, a manufactured hydrogenation catalyst such as cobalt molybdate or alumina or the like, or an organic or inorganic compound which has been recognized as having catalytic hydrogenation activity.

In those cases where the coal being liquefied contains ash-forming constituents which are catalytically active for promotion of the hydrogenation of aromatics to hydroaromatics, the solids withdrawn from the initial section of the liquefaction zone through line 36, line 37, or both, can be recycled to the downstream section of the liquefaction zone by entraining them in recycle solvent from line 38 or makeup solvent introduced through line 39 and passing the resulting slurry through line 40, pump 41, and injection line 42 containing valve 43, injection line 44 containing valve 45, or both injection lines simultaneously. Where mineral matter or ash produced from a different coal is to be employed as the catalyst, a manufactured catalyst is to be used, or other extraneous catalyst is to be employed, the catalytic material may be introduced into the system through line 46, entrained in solvent, and injected into reactor 27, reactor 28, or both of the reactors in the downstream section of the liquefaction zone. The use of mineral matter derived from a coal other than that being liquefied is often advantageous because such material is frequently available at little or no cost and because carbonaceous material associated with such mineral matter can be liquefied to augment the production of coal liquids.

In some instances it may be advantageous to liquefy two different types of coal, one containing catalytically active mineral constituents and the other containing inactive mineral constituents, the coal containing the relatively inert mineral matter being introduced into the initial section of the liquefaction zone and that containing the catalytically active material being introduced at a later stage in the liquefaction zone. Other catalytically active materials which may be employed to catalyze the hydrogenation reaction include the heavy liquefaction bottoms produced by the liquefaction of coals containing catalytically active materials and the ash produced by the pyrolysis or gasification of such coals. The use of such materials provides a means for not only promoting hydrogenation but also recovering carbon associated with the bottoms or ash which might otherwise be lost from the system. As indicated by line 47, liquefaction bottoms or similar material may be introduced into a solvent stream and subsequently injected into one or more reactors in the downstream portion of the liquefaction zone in much the same manner that manufactured hydrogenation catalysts and other catalytically active materials are introduced. A variety of different injection nozzles and similar equipment may be employed for this purpose and will be familiar to those skilled in the art.

The amount of catalytically active material introduced into the downstream section of the liquefaction zone is not highly critical since even small amounts of such material are beneficial. In general, however, it is preferred to introduce this material in concentrations of from about 1 to about 10% by weight, based upon the weight of the solids fed to the liquefaction zone. The optimum amount will depend in part upon the particular catalytically active material employed and can be readily determined. In the presence of such material, hydrogenation of aromatics by molecular hydrogen in the system to form hydroaromatics takes place, thus increasing the amount of donatable hydrogen present in the system and making possible higher liquid product yields than would otherwise be obtained. Injection of the catalyst into this section of the zone results in a concentration gradient such that the concentration of catalytically active material in the final section of the zone is greater than that in the initial section. As indicated earlier, such a gradient can be established by adding catalytically active material to the final section of the liquefaction zone or by both withdrawing catalytically active material from the initial section and adding such material to the final section.

The liquefaction zone effluent is withdarwn from reactor 28 through line 50. This stream will normally include gaseous products such as carbon monoxide, carbon dioxide, ammonia, hydrogen, hydrogen chloride, hydrogen sulfide, methane, ethane, ethylene, propane, propylene and the like. It will also include solvent, coal liquids ranging from naphtha boiling range materials through heavy liquefaction products normally boiling in excess of 1000° F., and entrained solids including unreacted coal, ash residues, and previously injected catalytically active material. This stream is passed from line 50 into liquefaction reactor effluent separator 51 where it is separated into an overhead vapor stream withdrawn though line 52 and a liquid stream taken off through line 53. Although only a single separator is shown, two or more separators may be provided. Heat exchange equipment not depicted in the drawing will normally be included to permit the condensation of liquids and recovery of heat for the generation of steam to be used elsewhere in the system.

The vapor stream withdrawn from separator 51 through line 53, after passing through heat recovery equipment not shown, is introduced into scrubbing unit 54 where the vapors are contacted with water and with an absorbent or solvent such as diethanolamine for the removal of hydrogen sulfide, carbon dioxide and other acid gas constituents in the conventional manner. Hydrocarbons condensed from the vapor are recovered as condensate through line 55 and gases are taken overhead through line 56. A portion of the gas stream will normally be purged through line 57 to prevent the buildup of carbon monoxide, light hydrocarbons, and other contaminants in excessive quantities. Makeup hydrogen is introduced into the gas stream through line 58, the gases are compressed sufficiently in compressor 59 to permit their recycle, and the high pressure stream is then passed through line 22 into the slurry being fed to the preheat furnace 23. It will be understood that the process is not restricted to the particular gas treating system shown and that separate scrubbers or similar equipment and solvents other than or in addition to diethanolamine can be employed if desired.

The liquids recovered from the liquefaction reactor effluent through line 52 are passed through pressure letdown valves and heat transfer equipment not shown in the drawing, and then fed into atmospheric fractionator 60. Here the liquid stream is fractionated at substantially atmospheric pressure to produce an overhead stream composed primarily of light hydrocarbon gases which is recovered through line 61, a naphtha stream boiling up to about 400° F. which is taken off through line 62, an intermediate liquid stream boiling between about 400° and about 700° F. which is withdrawn through line 63, and a heavier fraction normally boiling above about 700° F. which is withdrawn through line 64. Pumparound equipment, heat exchangers and other auxiliaries associated with the atmospheric fractionator are not shown. The overhead gases can be employed as fuel gas or used for other purposes. The naphtha stream may be withdrawn as product or alternatively combined with the intermediate boiling stream in line 63 and fed to the solvent hydrogenation unit as described hereafter. The heavier fraction recovered through line 64 is passed through the vacuum fractionator preheat furnace 65 and then introduced through line 66 into vacuum fractionator 67. The heavier fraction may in some cases alternatively be sent directly to vacuum fractionator 67 if desired.

In the vacuum fractionator, the liquids are further distilled under reduced pressure to produce an overhead fuel gas stream which is taken off through line 68, an intermediate fraction boiling between about 700° and about 800° F. which is passed through line 69 and combined with the 400° to 700° F. fraction from the atmospheric fractionator in line 63, a heavier fraction boiling between about 850° and about 1000° F. which is withdrawn through line 70, and a heavy bottoms fraction composed primarily of constituents normally boiling in excess of about 1000° F. which is recovered through line 71. This heavy fraction is referred to as the liquefaction bottoms and in the process shown will generally include suspended particles of unreacted coal and ash residues. In other processes employing gravity separation, centrifuges or the like for the removal of such solids, the suspended particles may be present in somewhat different concentrations. The liquefaction bottoms may constitute as much as 60% of the total effluent from the liquefaction stage of the process.

The nominal 400° to 700° F. fraction withdrawn from the atmospheric fractionator through line 63 and the 700° to 850° F. fraction from the vacuum fractionator in line 69 are combined in line 71. A portion of this liquid stream is combined with the nominal 850° to 1000° F. side stream from the vacuum fractionator in line 70 and passed through line 72 for withdrawal with products produced elsewhere in the system as 400° to 1000° F. coal liquids. The remaining 400° to 850° F. stream in line 71 is passed through line 73 to solvent hydrogenation preheat furnace 74. Recycle treat gas produced as described hereafter is added to this feed stream through line 75 prior to its introduction into the furnace. Within the furnace, the feed stream including the recycled gas is heated to the solvent hydrogenation temperature and then passed through line 76 to the first of a series of solvent hydrogenation reactors 77 and 78. These two reactors are interconnected by line 79 which may include one or more heat transfer units not shown in the drawing. The solvent hydrogenation reaction is an exothermic reaction and hence cooling or quenching is normally required to avoid excessive reaction temperatures, particularly in the second stage. Eighter liquid or gas quenching may be employed. Although two downflow fixed bed hydrogenation reactors are shown in the drawing, it will be understood that the process is not restricted to this particular hydrogenation reactor configuration and that in some cases a single stage unit or more than two stages may be advantageous.

The solvent hydrogenation unit will normally be operated at a pressure and temperature below those in the liquefaction unit in order to permit the hydrogenation of aromatics in the feed stream to hydroaromatics. The temperature, pressure and space velocity employed for solvent hydrogenation will depend to some extent upon the composition of the feed stream to this unit, the catalyst employed, and other factors. In general, however, temperatures within the range of about 550° F. and about 850° F., pressures between about 800 psig and about 3000 psig, and space velocities within the range between about 0.3 and about 3 pounds of feed/hour/pound of catalyst are preferred. Hydrogen treat rates sufficient to give hydrogen partial pressures in the reactor between about 500 and about 2000 psig will ordinarily be employed. In the particular system shown, the hydrogen used in the first stage is introduced upstream of the preheat furnace through line 75 and additional hydrogen is supplied to the second stage through line 80 where it serves in part to quench the reaction in the second stage. It is normally advantageous to maintain the mean hydrogenation temperature in the solvent hydrogenation zone as low as possible to maximize hydroaromatic yields, generally between about 675° F. and about 750° F.; a pressure between about 1500° and about 2500° F.; a liquid hourly space velocity between about 1 and about 2.5 pounds of feed/hour/pound of catalyst; and a hydrogen treat rate sufficient to give a hydrogen partial pressure between about 900 and about 1600 psig.

Any of a variety of conventional hydrotreating catalysts may be employed in the solvent hydrogenation zone. Such catalysts typically comprise an alumina or silica-alumina support carrying one or more iron group metals and one or more metals from Group VI-B metal of the Periodic Table in the form of an oxide or sulfide. Combinations of two or more Group VI-B metal oxides or sulfides are generally preferred. Representative metal combinations which may be employed in such catalysts include oxides and sulfides of cobalt-molybdenum, nickel-molybdenum-tungsten, cobalt-nickel-molybdenum, nickel-molybdenum and the like. A suitable catalyst, for example, may be a high metal content sulfided cobalt-molybdenum-alumina catalyst containing from 1 to 10 weight percent of cobalt oxide and from about 5 to about 40 weight percent of molybdenum oxide, preferably from 2 to 5 weight percent of the cobalt oxide and from about 10 to about 30 weight percent of the molybdenum oxide. Other metal oxides and sulfides in addition to those specifically referred to above, particularly oxides of iron, nickel, chromium, tungsten and the like, can also be used. Numerous commercial hydrogeantion catalysts suitable for use in the process of the invention are available from various catalyst manufacturers and will be familiar to those skilled in the art.

The reactions taking place in the solvent hydrogenation zone serve primarily to regenerate the hydrogen-donor solvent used for liquefaction purposes by converting aromatics into hydroaromatics. The hydrogenated effluent is withdrawn from the second stage 78 of the solvent hydrogenation zone through line 81, passed through heat exchange equipment not shown in the drawing, and introduced into liquid gas separator 82. A vapor stream withdrawn from the separator through line 83 is introduced into scrubbing unit 84 where the vapor is contacted with water and a solvent or absorbent such as diethanolamine for the removal of hydrogen sulfide, ammonia, carbon dioxide and other acid gases. Hydrocarbons condensed in the scrubbing unit are recovered as condensate through line 85. The gases are taken overhead through line 86 and a portion of the gas stream is purged by means of line 87 to prevent the buildup of undesirable constituents within the system. The remaining gases are combined with makeup hydrogen introduced through line 88, raised to solvent hydrogenation pressure in compressor 89, and then recycled to the solvent hydrogenation zone through lines 90, 89, 79, and 75. Again it will be understood that the process of the invention is not restricted to the particular procedures shown for treatment of the gases and that other procedures and different solvents may be employed if desired. Similarly, it will be understood that various heat exchangers and similar equipment that may be employed in the process are not shown in the schematic flow diagram depicted in the drawing.

The liquid portion of the solvent hydrogenation zone effluent is withdrawn from separator 82 through line 92 and, after suitable heat exchange in equipment not shown in the drawing, is introduced into solvent hydrogenation fractionator 93. Here the liquids are fractionated to produce an overhead stream taken off through line 94, a naphtha stream recovered through line 95, and a bottoms stream withdrawn through line 96. The overhead gases will be composed for the most part of hydrocarbon gases and can be employed as a fuel. The naphtha constitutes an additional product of the process. The high boiling materials withdrawn as a bottoms stream through line 96 is a regenerated donor solvent having a nominal boiling range between about 400° and about 850° F. This stream is recycled through line 96, line 97, and line 38 to the feed preparation and liquefaction stages of the process. This recycled solvent will have a relatively high donatable hydrogen content which will normally exceed the thermodynamic equilibrium value at the liquefaction temperature.

The heavy liquefaction bottoms withdrawn from vacuum fractionator 67 through line 99 is passed by means of pump 100 through line 101 to a fluidized bed coking unit 102. As indicated earlier, a portion of this stream can be recycled through line 47 to the liquefaction zone for use as a catalytically active material if the coal being processed contains catalytically active mineral constituents.

The coking unit employed in the process will normally be provided with an upper scrubbing and fractionating section 103 from which liquid and gaseous products produced as a result of the coking reactions can be withdrawn. The unit will also generally include one or more cyclone separators or similar devices not shown in the drawing which serve to remove entrained particles from the upflowing gases and vapors entering the scrubbing and fractionating section and return them to the fluidized bed below. A plurality of feed lines 104 will ordinarily be provided to obtain better distribution of the feed material with the coking unit.

The reaction section of the fluidized bed coking unit shown in the drawing contains a bed of coke particles which are maintained in the fluidized state by means of steam and other fluidizing gas introduced near the bottom of the unit through line 105. This fluidized bed is normally maintained at a temperature between about 900° F. and about 1300° F. by means of hot char which is introduced into the upper part of the reaction section through line 106. The pressure within the reaction zone will generally range between about 10 and about 30 psig but higher pressures can be employed if desired. The optimum conditions in the reaction zone will depend in part upon the characteristics of the particular feed material employed and can be readily determined.

The hot liquefaction bottoms fraction is fed into the reaction zone of the coking unit through feed lines 104 and sprayed onto the surfaces of the coke particles in the fluidized bed. Here it is rapidly heated to bed temperatures.

As the temperature of the bottoms increases, lower boiling constituents are vaporized and the heavier portions undergo thermal cracking and other reactions to form lighter products and additional coke on the surfaces of the bed particles. Vaporized products, unreacted steam, and entrained solids move upwardly through the fluidized bed and into the cyclone separators or similar devices where solids present in the fluids are rejected. The fluids then move into the scrubbing and fractionation section of the unit where refluxing takes place. An overhead gas stream is withdrawn from the coker through line 107 and may be employed as fuel gas or the like. A naphtha stream is taken off through line 108 and can be combined with naphtha produced at other stages in the process. A heavier liquids fraction having a nominal boiling range between about 400° and about 1000° F. is withdrawn as a side stream through line 109 and combined with coal liquids in line 72 for withdrawal from the system. A heavier pyrolysis bottoms stream having a nominal boiling range in excess of about 1000° F. is withdrawn from the coking unit through line 110 and may be recycled to the incoming feed stream for further processing. If desired, this material, which will contain ash constituents, may be passed through lines 111 and 47 for use as a catalyst in the liquefaction zone, provided that the coal being processed is one containing catalytically active mineral constituents.

The coke particles in the fluidized bed of the coker reaction section tend to increase in size as additional coke is deposited. These particles thus gradually move downwardly through the fluidized bed and are eventually withdrawn from the reaction section through line 112 as a dense phase solids stream. This stream is picked up by steam or other carrier gas introduced through line 113 and transported upwardly through lines 114 and 115 into the fluidized bed heater 116. Here the coke particles in the fluidized bed of the heater are heated to a temperature of from about 100° to about 300° F. above that in the reaction section of the coker. Hot solids are withdrawn from the bed of heater 116 through standpipe 117, picked up by steam or other carrier gas introduced through line 118, and returned to the reaction section of the coker through line 106. The circulation rate between the coker and heater is maintained sufficiently high to provide the heat necessary to keep the coker at the required tmperature. The solids within the heater can either be heated directly by the introduction of air or oxygen or by the passage of hot gases from an associated gasifier as described below.

If the solids in heater 116 are to be heated by direct injection of air or oxygen-containing gas, valve 19 in line 120 will be open and the air or oxygen-containing gas required will be passed upwardly through line 115 into the bottom of the heater. Flue gases taken overhead from the heater through line 121 will be passed through valve 122 and line 123 for the removal of solids and contaminants prior to discharge of the gases into the atmosphere or their use for other purposes. In this mode of operation, valves 124 and 125 are normally closed.

The coking unit shown in the drawing includes an associated gasifier for the gasification of coke particles to produce a hydrogen-containing gas. Alternatively, the gasifier may be omitted, the coke being sent directly to another type of hydrogen generation facilities such as a fixed bed catalytic or noncatalytic system, if desired. In the particular case shown, hot carbonaceous particles are continuously circulated from the fluidized bed in heater 116 through line 126 to the fluidized bed gasifier 127. Here the coke particles are contacted with steam introduced into the lower end of the gasifier through line 128. The hot coke particles are gasified by the steam to produce a gas containing hydrogen, carbon monoxide, carbon dioxide and in some cases methane. This gas is taken overhead from the gasifier through line 129, passed through valve 130, and discharged through line 131 downstream upgrading equipment where the gas may be shifted over a shift catalyst to increase the ratio of hydrogen to carbon monoxide, where the acid gases may be removed, and where the residual carbon monoxide may be catalytically methanated to produce a high purity hydrogen stream suitable for use as makeup hydrogen for the liquefaction and solvent hydrogenation steps of the process. Conventional shift, acid gas removal and methanation procedures can be employed. In this mode of operation, valves 132 and 133 are normally closed.

A stream of hot carbonaceous solids is continuously withdrawn from the gasifier through standpipe 134, entrained in steam, flue gas or other carrier gas introduced through line 135, and returned to heater 116 through line 136. The solids circulation rate between the heater and gasifier is sufficient to maintain a gasifier temperature within the range between about 1300° and about 1900° F. or higher. It is generally preferred to operate the coking unit at a temperature between about 900° and about 1300° F. and to operate the fluidized bed heater at a temperature of from about 1000° to about 1600° F. It is normally preferred to operate the gasifier at a temperature between about 1500° and about 1800° F. A gasification catalyst can be employed in the gasifier to accelerate the gasification rate if desired. Suitable catalysts include alkali metal compounds such as potassium carbonate and potassium hydroxide. The alkali metal compounds used as catalysts can be introduced into the gasifier itself or added upstream of the gasifier. Alkaline earth metal compounds also can be employed to catalyze the gasification if the compounds employed are added to the liquefaction bottoms upstream of the coking unit.

In lieu of introducing air or an oxygen-containing gas into the fluidized bed heater through line 120 as described above, hot gases taken overhead from the gasifier through line 129 can be passed through valve 132, line 140, valve 125 and line 115 to the heater. In this case valves 119 and 122 will normally be closed. Air or oxygen-containing gas is introduced into the system through line 141 and passed into the gasifier with the steam employed for gasification purposes. The amount of air or oxygen-containing gas thus provided is adjusted so that the required gasification temperatures are maintained in gasifier 127. The hot gases passing from the gasifier to the fluidized bed heater transfer heat to the solid particles within the heater and maintain them at the required temperature level. The gas taken overhead from the heater in this case will include the gasification products. This stream, assuming that oxygen rather than air is injected into the lower end of the gasifier with the steam used for gasification purposes, will consist primarily of hydrogen, carbon monoxide, carbon dioxide, and some methane. These gases are taken overhead through line 121, valve 124 and line 142. Valve 122 is normally closed. The gases thus withdrawn will generally be passed to downstream gas upgrading equipment for shifting of the gas, removal of acid gases and methanation of residual carbon monoxide by conventional procedures to produce a high purity hydrogen stream. This hydrogen can then be compressed and employed in the liquefaction and solvent hydrogenation steps of the process. If desired, additional hydrogen can be produced by the steam reforming of a part of all of the flue gas generated in the process. Following such a steam reforming step, the resultant gases can be processed for the recovery of high purity hydrogen in much the same manner as the gases produced in the steam gasification step of the process.

The gasification of coke produced in the coking unit results in the formation of ash containing mineral constituents introduced into the system with the feed coal. If the coal includes catalytically active mineral constituents which promote the hydrogenation of aromatics to form hydroaromatics, the ash recovered from the gasifier through line 143 can be employed as the catalytic material introduced into the downstream section of the liquefaction zone. This material may be introduced through line 46 into a stream of solvent in line 40 and thereafter passed into either or both of the liquefaction reactors in the downstream section of the zone.

It will be apparent from the foregoing that the process of this invention has pronounced advantages over earlier hydrogen-donor solvent coal liquefaction processes. It makes possible the maximum utilization of molecular hydrogen in the liquefaction zone and provides an adequate donor hydrogen level at the outlet of the zone where the donor hydrogen supply is most critical. It permits high coal conversion rates and improved coal liquid yields, as well as having other advantages. As a result, the process has widespread potential application.

We claim:

1. A hydrogen-donor liquefaction process for converting coal or similar carbonaceous solids into lower molecular weight liquid hydrocarbons which comprises:

(a) contacting said carbonaceous solids with a hydrogen-donor solvent and molecular hydrogen at a temperature in the range between about 775° F. and about 950° F. in a liquefaction zone operated such that the temperature remains substantially constant throughout said zone and wherein said carbonaceous solids are converted into lower molecular weight liquid hydrocarbons to form a liquefaction effluent, said hydrogen-donor solvent having a donatable hydrogen concentration higher than the thermodynamic equilibrium concentration at the temperature in said liquefaction zone when said solvent enters said zone;

(b) maintaining a higher concentration of catalytic material that is active in promoting the hydrogenation of aromatics to form hydroaromatics in said liquefaction zone near said outlet of said zone than near said inlet of said zone; and (c) recovering liquid hydrocarbonaceous products from said liquefaction effluent.

2. A process as defined by claim 1 wherein said higher concentration is maintained by introducing catalytic material that is active in promoting the hydrogenation of aromatics to form hydroaromatics into said liquefaction zone near said outlet.

3. A process as defined by claim 1 including the step of withdrawing mineral constituents of said carbonaceous solids from said liquefaction zone near said inlet of said zone.

4. A process as defined by claim 1 wherein said higher concentration is maintained by introducing a manufactured hydrogenation catalyst into said liquefaction zone downstream of the midpoint of said zone.

5. A process as defined by claim 1 wherein said carbonaceous solids include mineral constitutents that are active in promoting the hydrogenation of aromatics to form hydroaromatics and said high concentration is maintained by withdrawing mineral constituents from said solids at a point upstream of the midpoint of said liquefaction zone and reintroducing said mineral constituents into said liquefaction zone at a point downstream of the midpoint of said liquefaction zone.

6. A process as defined by claim 1 wherein said higher concentration is maintained by introducing an iron-containing mineral that is active in promoting the hydrogenation of aromatics to form hydroaromatics into said liquefaction zone at a point where the donatable hydrogen concentration of said solvent in said zone is below the thermodynamic equilibrium concentration at the temperature in said zone.

7. A process as defined by claim 1 wherein said higher concentration is maintained in said liquefaction zone by introducing liquefaction bottoms produced from a coal containing mineral constituents that are active in promoting the hydrogenation of aromatics to form hydroarmoatics into said liquefaction zone at the point where the donatable hydrogen concentration is below the thermodynamic equilibrium concentration at the temperature in said liquefaction zone.

8. A process as defined by claim 1 wherein said higher concentration in said liquefaction zone is maintained by introducing mineral matter produced from a coal containing mineral constituents that are active in promoting the hydrogenation of aromatics to form hydroaromatics into said zone at a point where the concentration of donatable hydrogen is below the thermodynamic equilibrium concentration at the temperature in said zone.

9. A process as defined by claim 1 wherein said liquefaction zone comprises a series of liquefaction reactors all of which are operated at substantially the same temperature.

10. A process as defined by claim 8 wherein said mineral matter is derived from a coal which is different from the feed solids to said liquefaction zone.

11. A process as defined by claim 8 wherein said mineral matter is derived by the gasification of coke produced from liquefaction bottoms.

12. A process as defined by claim 8 wherein said mineral matter is contained in pyrolysis bottoms produced by the pyrolysis of liquefaction bottoms.

13. A hydrogen-donor liquefaction process for converting coal or similar carbonaceous solids into lower molecular weight liquid hydrocarbons which comprises:

(a) contacting said carbonaceous solids with a hydrogen-donor solvent and molecular hydrogen at a temperature in a range between about 775° F. and about 950° F. in a liquefaction zone operated such that the temperature remains substantially constant throughout said zone and wherein said carbonaceous solids are converted into lower molecular weight liquid hydrocarbons to form a liquefaction effluent;

(b) maintaining a higher concentration of catalytic material that is active in promoting the hydrogenation of aromatics to form hydroaromatics in the portion of said liquefaction zone where the donatable hydrogen concentration of the said solvent is below the thermodynamic equilibrium concentration at the temperature in said zone, thereby maintaining a relatively high concentration of donatable hydrogen throughout said liquefaction zone by the in situ hydrogenation of said solvent to convert the aromatics in said portion of said liquefaction zone into hydroaromatics;

(c) separating said liquefaction effluent into a vaporous fraction and a liquid fraction;

(d) recovering a substantially solids free liquid hydrocarbon stream containing hydrogen-donor solvent constituents from said liquid fraction;

(e) hydrogenating said liquid hydrocarbon stream in a catalytic solvent hydrogenation zone at a temperature below the temperature in said liquefaction zone to produce a hydrogenated effluent containing hydrogen-donor constituents;

(f) recovering a liquid fraction containing said hydrogen-donor solvent constituents from said hydrogenated effluent; and (g) recycling at least a portion of said liquid fraction recovered in step (f) as hydrogen-donor solvent to said liquefaction zone.

14. A process as defined by claim 13 wherein said liquefaction zone is maintained at a substantially constant temperature in the range between about 800° F. and about 900° F. and said catalytic solvent hydrogenation zone is maintained at the temperature in the range between about 675° F. and about 750° F.

15. A process as defined by claim 13 wherein said higher concentration is maintained by introducing catalytic material that is active in promoting the hydrogenation of aromatics to form hydroaromatics into said liquefaction zone at a point where the donatable hydrogen concentration of said solvent in said zone is below the thermodynamic equilibrium concentration at the temperature in said zone.

16. A hydrogen-donor liquefaction process for converting coal or similar carbonaceous solids into lower molecular weight liquid hydrocarbons which comprises:

(a) contacting said carbonaceous solids with a hydrogen-donor solvent and molecular hydrogen at a temperature in the range between about 775° F. and about 950° F. in a liquefaction zone operated such that the temperature remains substantially constant throughout said zone and wherein said carbonaceous solids are converted into lower molecular weight liquid hydrocarbons to form a liquefaction effluent, said hydrogen-donor solvent having a donatable hydrogen concentration higher than the thermodynamic equilibrium concentration at the temperature in said liquefaction zone when said solvent enters said zone;

(b) maintaining a higher concentration of catalytic material that is active in promoting the hydrogenation of aromatics to form hydroaromatics in the portion of said liquefaction zone where the donatable hydrogen concentration of the said solvent is below the thermodynamic equilibrium concentration at the temperature in said zone, thereby maintaining a relatively high concentration of donatable hydrogen throughout said liquefaction zone by the in situ hydrogenation of said solvent to convert the aromatics in said portion of said liquefaction zone into hydroaromatics; and (c) recovering liquid hydrocarbonaceous products from said liquefaction effluent.

17. A process as defined by claim 16 wherein said higher concentration is maintained by introducing catalytic material that is active in promoting the hydrogenation of aromatics to form hydroaromatics into said liquefaction zone at a point where the donatable hydrogen concentration of said solvent in said zone is below the thermodynamic equilibrium concentration at the temperature in said zone.

* * * * *